US006026753A

United States Patent [19]

Sharpe

[11] Patent Number: 6,026,753

[45] Date of Patent: Feb. 22, 2000

[54] RETRACTABLE TOOL SUPPORT

[76] Inventor: William N. Sharpe, 789 Harbison Avenue East, Winnipeg Manitoba, Canada, R2L 0Z4

[21] Appl. No.: 08/985,318

[22] Filed: Dec. 4, 1997

Related U.S. Application Data

[60] Provisional application No. 60/033,222, Dec. 4, 1996.

[51] Int. Cl.[7] ..... A47B 5/00

[52] U.S. Cl. ..... 108/48; 108/42

[58] Field of Search ..... 108/48, 47, 38, 108/36, 35, 40, 41, 42, 152

[56] References Cited

U.S. PATENT DOCUMENTS

| | | | |
|---|---|---|---|
| 1,503,689 | 8/1924 | Kroschel | 108/42 X |
| 2,845,114 | 7/1958 | Edwards . | |
| 3,242,882 | 3/1966 | Hoyt | 108/48 |
| 3,745,935 | 7/1973 | Douglas . | |
| 4,995,322 | 2/1991 | Frederick | 108/38 X |
| 5,503,086 | 4/1996 | Hoffman et al. . | |
| 5,544,592 | 8/1996 | Leezer | 108/48 |

FOREIGN PATENT DOCUMENTS

| | | | |
|---|---|---|---|
| 287546 | 12/1968 | Australia | 108/48 |
| 3312892 | 3/1984 | Germany | 108/48 |
| 280532 | 12/1964 | Netherlands | 108/48 |

*Primary Examiner*—Jose V. Chen

*Attorney, Agent, or Firm*—Murray E. Thrift; Adrian D. Battison

[57] ABSTRACT

A retractable tool support mounts on a wall or other structure above a shop floor. The support is movable between a stored position and a use position. In the stored position. a tool carrier is horizontal and at an elevated position against the wall. In the use position, the tool carrier is horizontal and at a lowered position spaced out from the wall for access. The tool support includes a spring biased linkage biasing the support towards the stored position and counterbalancing the weight of a tool mounted on the tool carrier. The linkage maintains the tool carrier and tool in a horizontal orientation as the support is moved between the stored and use positions. A latch holds the support in the stored position.

11 Claims, 11 Drawing Sheets

RETRACTABLE TOOL SUPPORT

RETRACTABLE TOOL SUPPORT

This application claims the benefit of U.S. Provisional Application No. 60/033,222 filed Dec. 4, 1996.

FIELD OF THE INVENTION

The present invention relates to tool supports, particularly of the type for retractably mounting and supporting tools on walls and similar vertical surfaces.

BACKGROUND OF THE INVENTION

Many tools, for example small table saws, band saws, drill presses, and bench grinders may be mounted on a work bench or stand. These tools when so mounted can take up a considerable amount of the space available in a small work shop. Where space is limited there is often not enough space to work easily and safely if one or more such tools is in the shop.

Prior tool supports are known for mounting a tool in a work shop. Wall brackets for tools are known which fix a tool on a wall so that the tool is secured to the wall and cannot move. This can result in the tool getting in the way when an individual is working in the area of the tool on tasks which do not require use of the tool. Furthermore brackets of this type are often tool specific and cannot be used with tools of various types.

Stands which support tools above the floor are also known, one example being a stand for a drill press. These stands tend to take up floor space and are usually fixed in place or are heavy and difficult to move. As a result they can cause difficulties for individuals moving around in the work shop which can be inconvenient or dangerous.

Portable tool supports are also known however these generally require that an individual set up the support and mount the tool on the support every time the tool is to be used, then remove of the tool from the support and transport the support and tool to another location for storage. This can be time consuming and inconvenient.

SUMMARY OF THE INVENTION

According to the present invention there is provided a tool support for mounting a tool for movement between a stored position adjacent an upright mounting structure and a use position below the stored position and spaced from the upright mounting structure, said tool support comprising:

- mounting means for mounting the tool support on the mounting structure;
- tool carrier means for carrying the tool in an upright orientation;
- linkage means coupling the mounting means and the tool carrier means for constraining the tool carrier to move between the stored and use positions with the tool remaining in said upright orientation;
- a carrier support strut supporting the tool carrier means and the tool in the use position; and
- selectively releasable latch means for latching the tool carrier means in the stored position.

BRIEF DESCRIPTION OF THE DRAWINGS

In the accompanying drawings, which illustrate an exemplary embodiment of the present invention.

DETAILED DESCRIPTION

Figure 1:
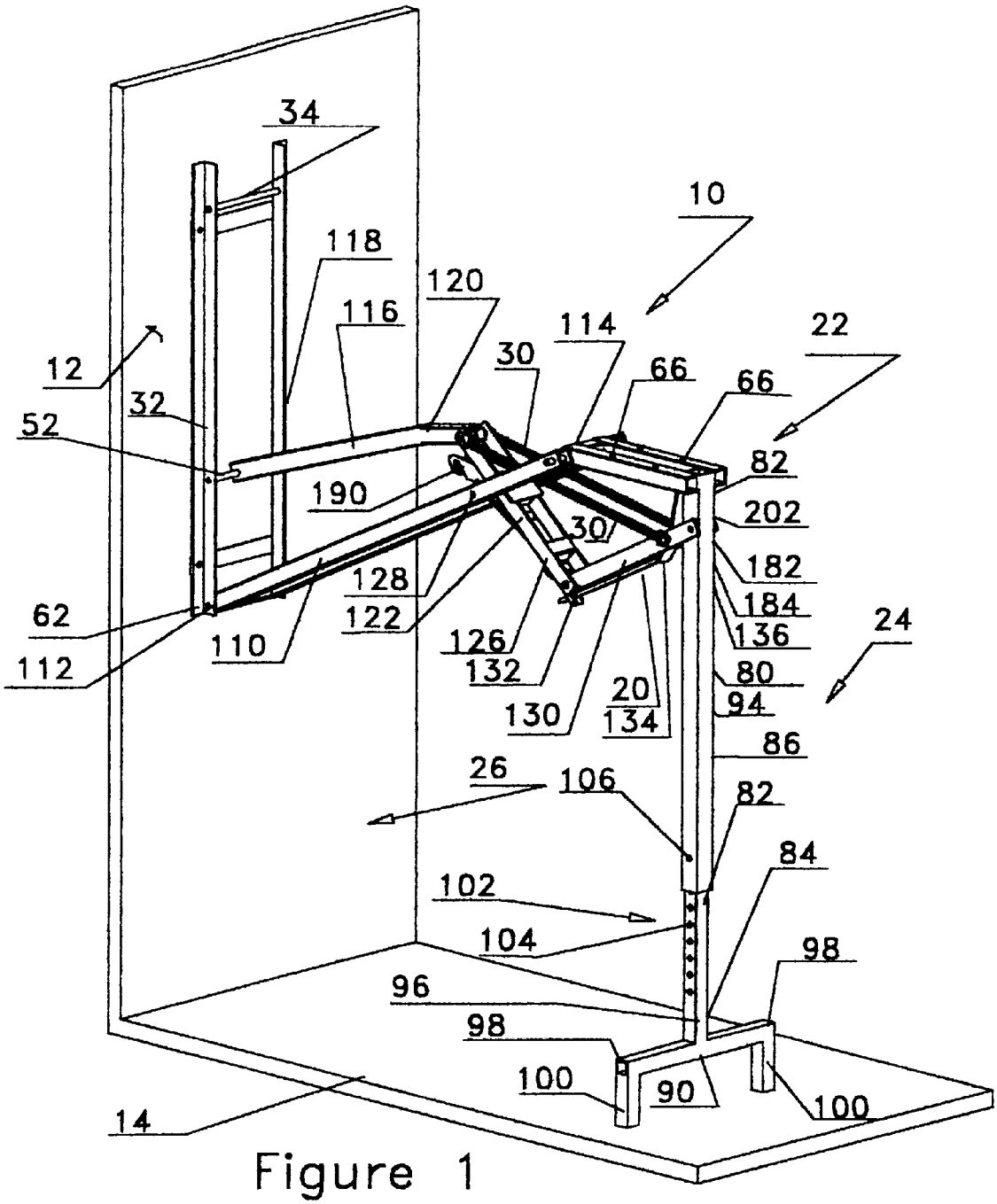
FIG. 1 shows an isometric view of a retractable tool support mounted on a wall and in the use position.
Figure 2:
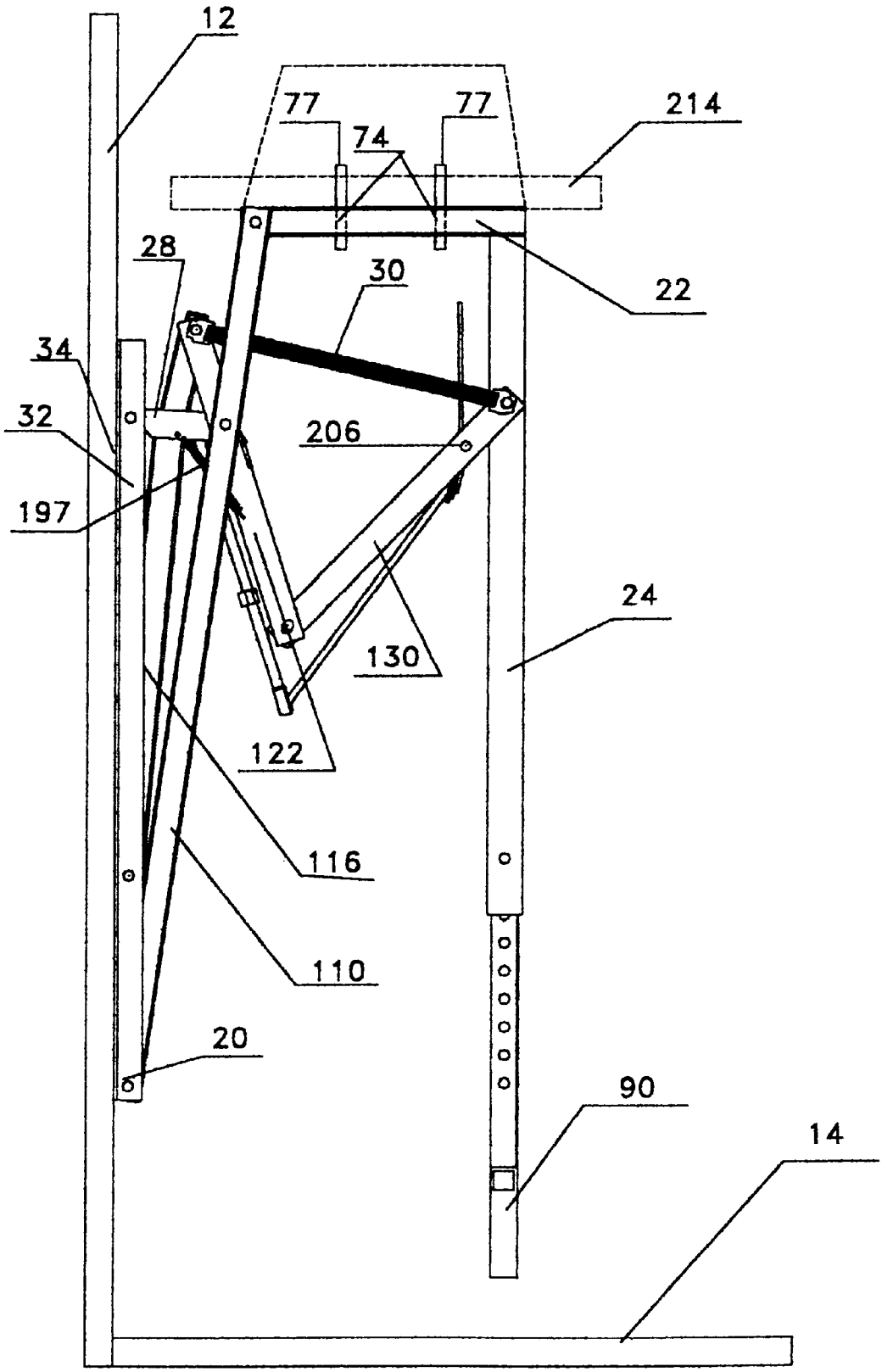
FIG. 2 is a side view of the retracted tool support mounted on the wall and in the stored position.
Figure 3:
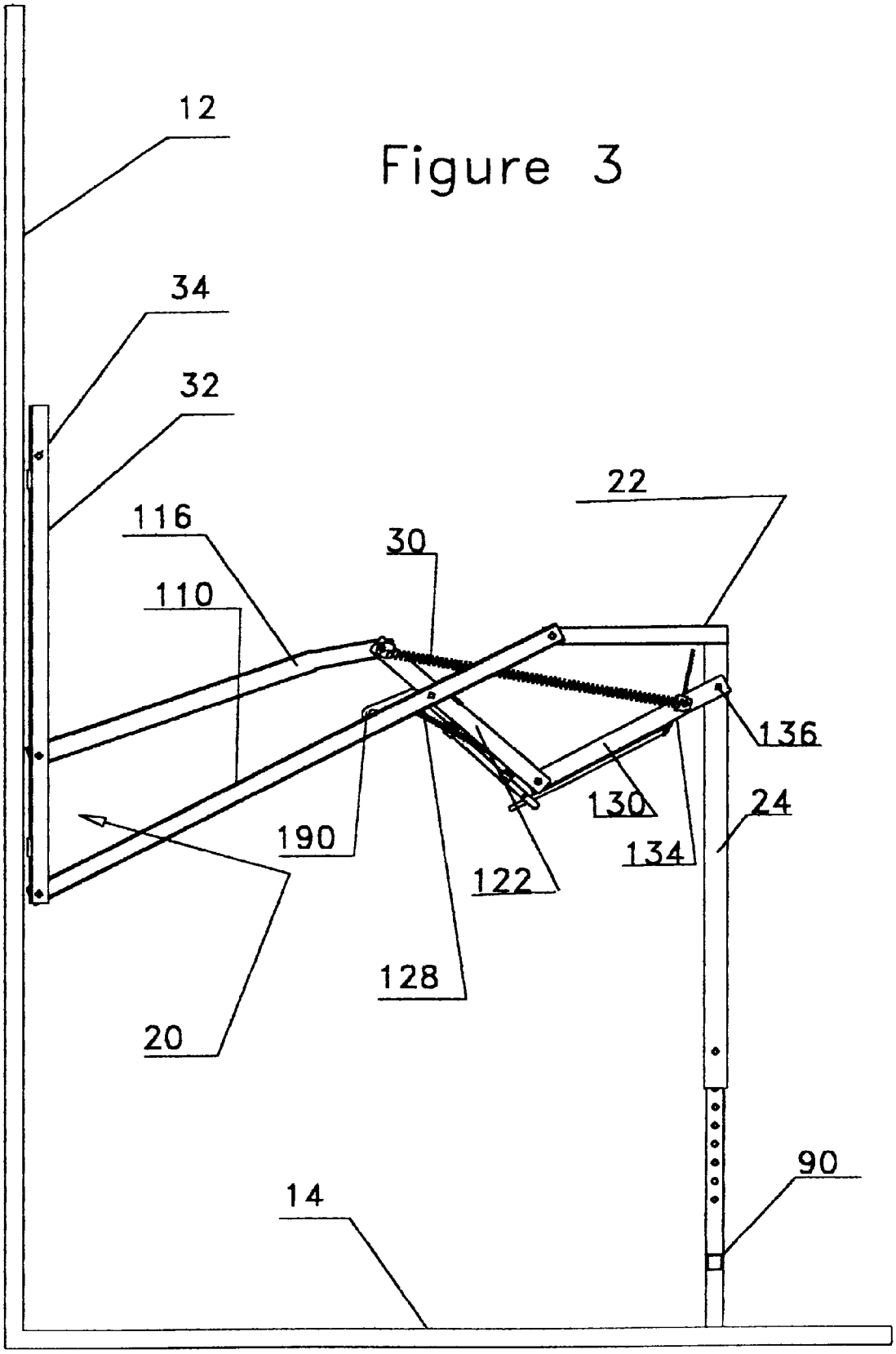
FIG. 3 is a side view of the retractable tool support mounted on a wall and in the use position.
Figure 4:
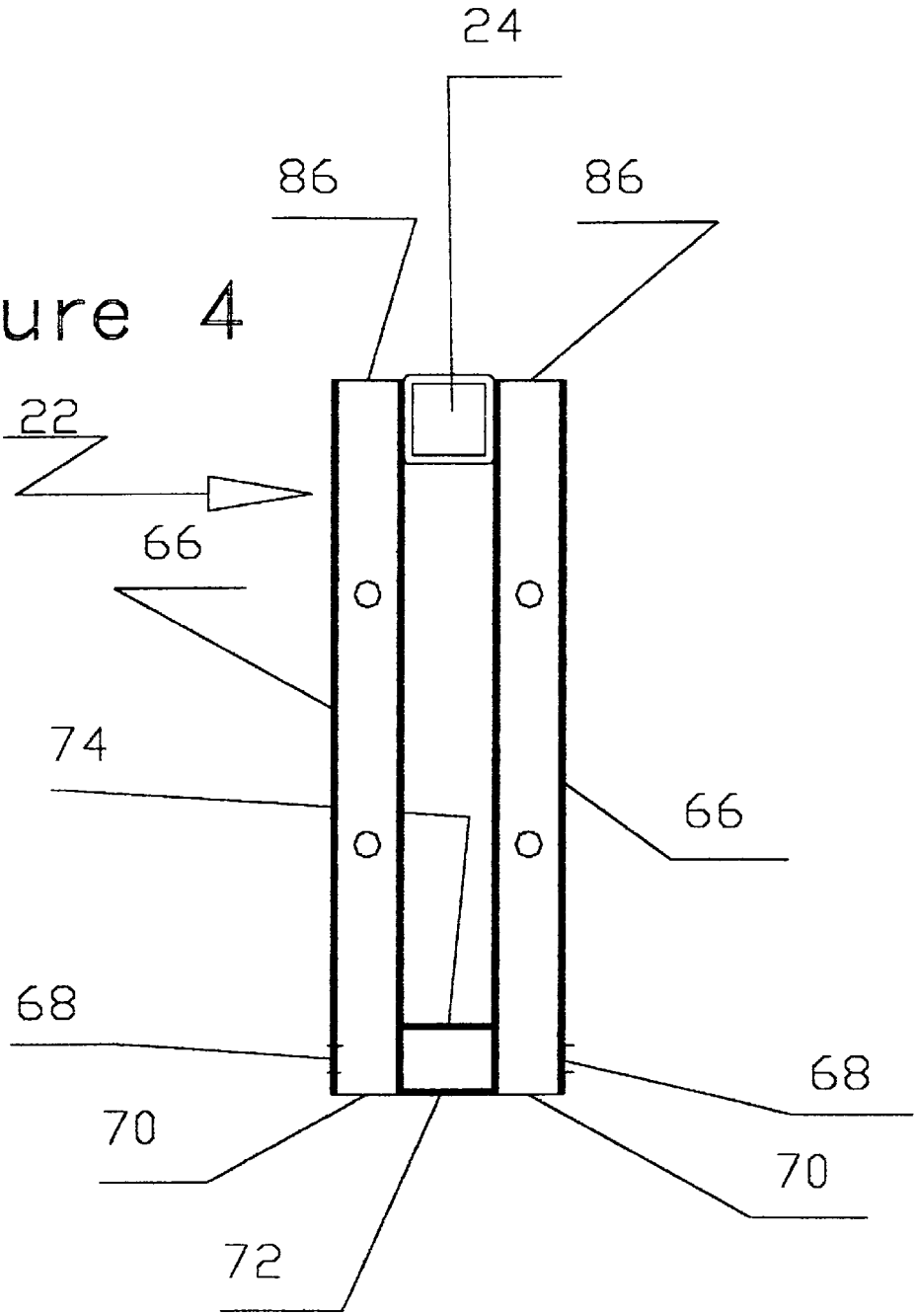
FIG. 4 is a top view of the tool mount.
Figure 5:
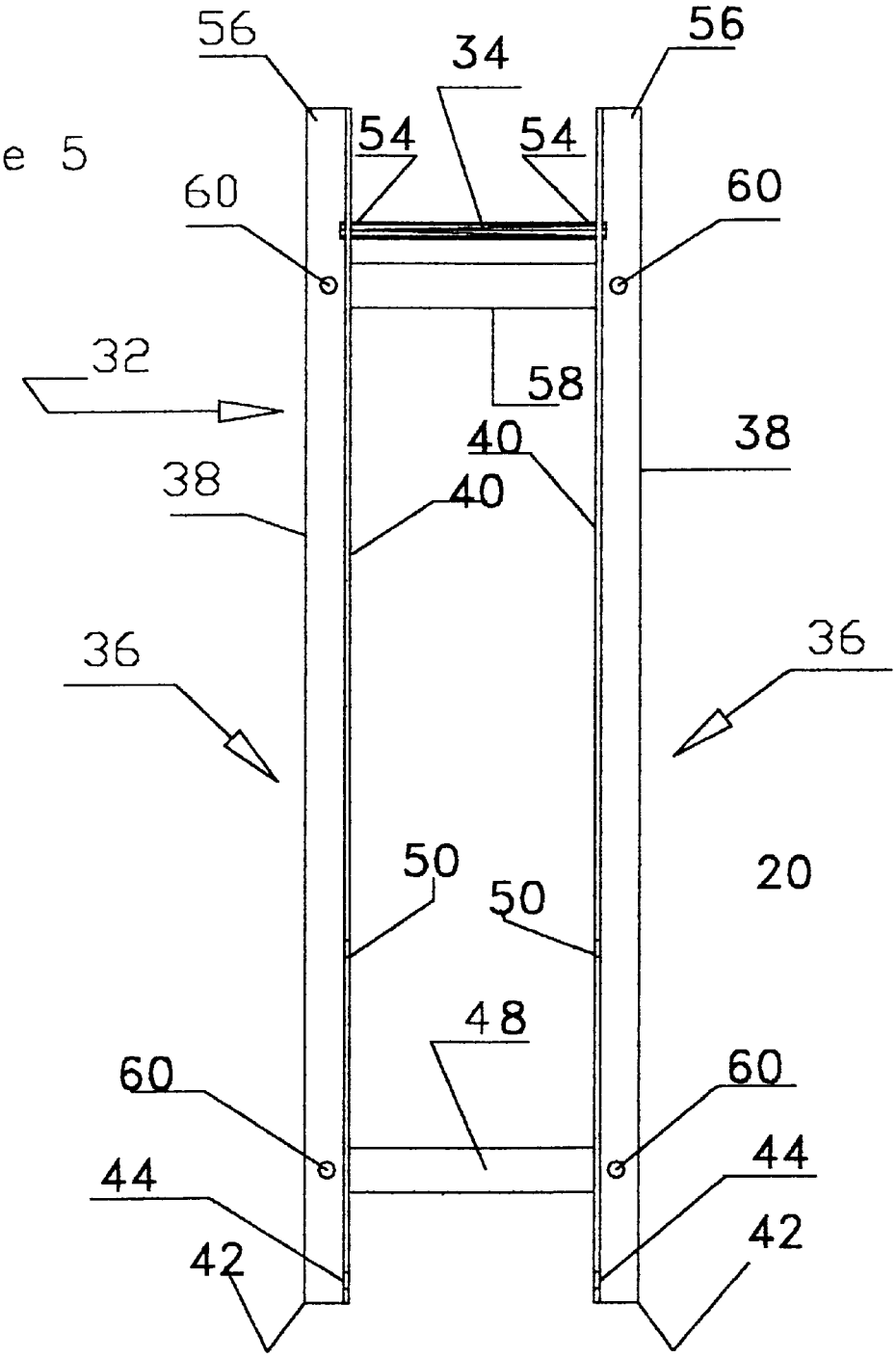
FIG. 5 is a front view of the wall bracket showing the linkage mount and the latch pin.

Referring to FIGS. 1, 2 and 3 the retractable tool support is shown generally at 10. The retractable tool support 10 mounts on a wall 12 above the shop floor 14 and is movable between a stored position 16 and an extended, use position 18. The retractable tool support 10 comprises a linkage mount 20, a tool carrier 22, a leg carrier support strut in the form of 24, a linkage 26, a latch means 28, and biasing means 30 for biasing the tool support towards the stored position 16 thereby counterbalancing the weight of the tool support 10.

Referring to FIGS. 1, 2, 3 and 5 the retractable tool support 10 is mounted on the wall 12 by a wall bracket 32 which supports the linkage mount 20 and the latch pin 34. The wall bracket 32 comprises a pair of spaced apart elongate upright angle members 36 arranged such that one flange 38 of each angle member lies adjacent the wall 12 and extends laterally outwards from the bracket 32. The other flange 40 of each angle member 36 extends outwards and forwards of the wall 12. Adjacent the bottom end 42 of each angle member 36 is a hole 44 extending laterally through the flange 40. The holes 44 are arranged to align with one another such that a pin member 62 can be arranged to extend therethrough.

A second hole 50 extends laterally through each of the flanges 40. The holes 50 are arranged to align with one another such that a pin member 52 can be arranged to extend therethrough.

A third hole 54 extends laterally through the flange member 40 of each angle member 36 at a location spaced down from a top end 56 of the respective angle member 36. The holes 54 are aligned with one another to receive the latch pin 34 which extends therethrough.

A strapping member 48 extends between the angle members 36 and is arranged at a location spaced upwards from the holes 44 in the flange 40.

A second strapping member 58 extends between the angle members 36 at a location adjacent the top ends 56 thereof.

A plurality of holes 60 extend through the flange 38 of each of the angle members 36. The holes 60 are located adjacent the top and bottom ends 56 and 42 of the angle member 36 with one hole lying adjacent each respective one of said ends. The holes 60 receive a fastener therethrough for fastening the mounting bracket onto the wall 12.

The linkage mount 20 is provided by a bottom portion of the mounting bracket 32 and comprises the holes 44 and 50 in the flanges 40 which receive pin members 52 and 62 which support the bottom end of the linkage 26.

Referring to FIGS. 1, 2, 3 and 4 tool carrier 22 is arranged for supporting a tool thereon. The tool carrier 22 supports a tool such that the tool carrier and tool remain in a substantially horizontal orientation at all times. The tool carrier 22 comprises a pair of spaced apart elongate members 66 which are arranged to lie coplanar in a substantially horizontal plane. A hole 68 extends laterally through each elongate member 66 adjacent a first end 70 of each said member. A spacer 72 is arranged between the elongate members 66 and is aligned with the holes 68. The spacer 72 includes a hole 74 extending laterally through it which aligns with the holes 68 in the elongate members 66 for receiving a securing pin.

The tool carrier 22 includes tool mounting means which comprise a pair of holes 76 extending vertically through each pair of spaced apart elongate members 66 and which are arranged to align with a pair of holes in the tool or in a tool mounting plate. A bolt 77 or similar fastener engages through the pair of holes hole 76 and the holes in the tool or mounting plate thereby securing the tool to the tool carrier 22. This allows the tool support 10 to be used to support different types of tools by first fixing the tool to a mounting plate.

The leg 24 comprises a substantially vertical elongate member 80 extending from a top end 82 connected to the tool carrier 22 downwards to a bottom end 84 which supports the tool carrier 22 on the floor or other supporting surface 14. The leg 24 helps support the weight of the tool when the retractable tool support 10 is in the use position 18 so that the tool support and tool do not move during use and so that the weight of the tool does not pull the tool support 10 off of the wall 12.

The leg 24 is fixed at its top end 82 between the elongate members 66 of the tool carrier 22 at a second end 86 thereof. The leg 24 is fixed substantially perpendicular to the tool carrier 22 and extends downwards therefrom.

The leg 24 comprises an upper portion 86, a lower portion 88 and a foot member 90. The upper portion 86 comprises an elongate tubular member fixed at the top end 82 of the tool carrier 22 and extending downwards therefrom to a bottom end 92. The lower portion 88 comprises an elongate tubular member having a top end 94 which is slidably arranged within the upper portion 86 and extends therefrom to a bottom end 96. The foot member 90 is fixed to the bottom end 96 of the lower portion 86 for engaging the floor 14. The foot member 90 includes an elongate member 97 fixed to the bottom end 96 of the lower portion 86. The elongate member 97 extends laterally of the lower portion 86 to opposing ends 98. A downwardly projecting member 100 extends downwards from each end 98 of the elongate member 97 and engages the floor 14 at its bottom end.

The leg 24 includes adjustment means 102 for vertically repositioning the bottom end 84 to allow the tools to be mounted on the wall at one of a number of desired heights with the support member 24 supporting the tool carrier 22 on the floor 14. The adjustment means 102 comprise a plurality of holes 104 extending through the lower portion 86 of the leg 24 and spaced apart longitudinally therealong. A hole 106 extends through the upper portion 87 and is arranged for selectively cooperating with a respective one of the plurality of holes 104 in the lower portion 86. A pin member 108 engages through the cooperating holes 106 and 104 thereby securing the upper and lower portions 86 and 87 relative to one another.

The linkage 26 is connected at a bottom end to the linkage mount 20 and a top end to the tool carrier 22 and extends therebetween. The linkage 26 is movable between a stored position 16 with tool carrier 22 positioned above the linkage mount 20 in a substantially upright position and adjacent the wall 12 and with the foot 90 of the leg 24 is spaced upwards from the floor 14 and an use position 18 with the tool carrier 22 spaced downwards and forwards of the stored position 16 and outwards from the wall 12 and such that the foot 90 of the leg 24 lies in contact with the floor 14. This enables the retractable tool support 10 to be moved upwards and out of the way when the tool is not in use, and allows the tool to be moved downwards and out from the wall 12 when the tool is in use. Moving the tool support 10 to the stored position 16 when not in use keeps the floor 14 beneath the tool support 10 free from clutter and allows for easy clean up and movement over that part of the floor 14.

Referring to FIGS. 1, 2 and 3 the linkage 26 comprises four linkage members. The first elongate linkage member 110 is pivotally connected at a bottom end 112 to the linkage mount 20 and is pivotally connected at a top end 114 to the first end 70 of the tool carrier 22. The second linkage member 116 is pivotally connected at a bottom end 118 to the linkage mount 20 at a point spaced upwards from the bottom 112 of the first linkage member 110 and extends upwards therefrom to a top end 120. The third elongate linkage member 122 extends from a first end 124 to a second 126. The third linkage member 122 is fixed at a point 128 between said first and second ends 124 and 126 to the first linkage member 110 and is pivotally fixed adjacent the first end 124 to the top end 120 the second linkage member 116. The fourth elongate linkage member 130 extends from a first end 132 to a second end 134 and is pivotally fixed at the first end 132 to the second end 126 of the third linkage member 122 and is pivotally fixed at the second end 134 to the leg 24 at a point 136 spaced downwards from the top end 82 thereof. The complete linkage acts as two four bar linkages connected in series between the mount and the tool carrier. The linkages have two common bars, linkage members 110 and 122. The linkage members 110, 116, 130 and 122 constitute first through fourth bars respectively of the combined four bar linkages, with the remaining two elements being the mount and the tool carrier-leg combination.

Figure 6:
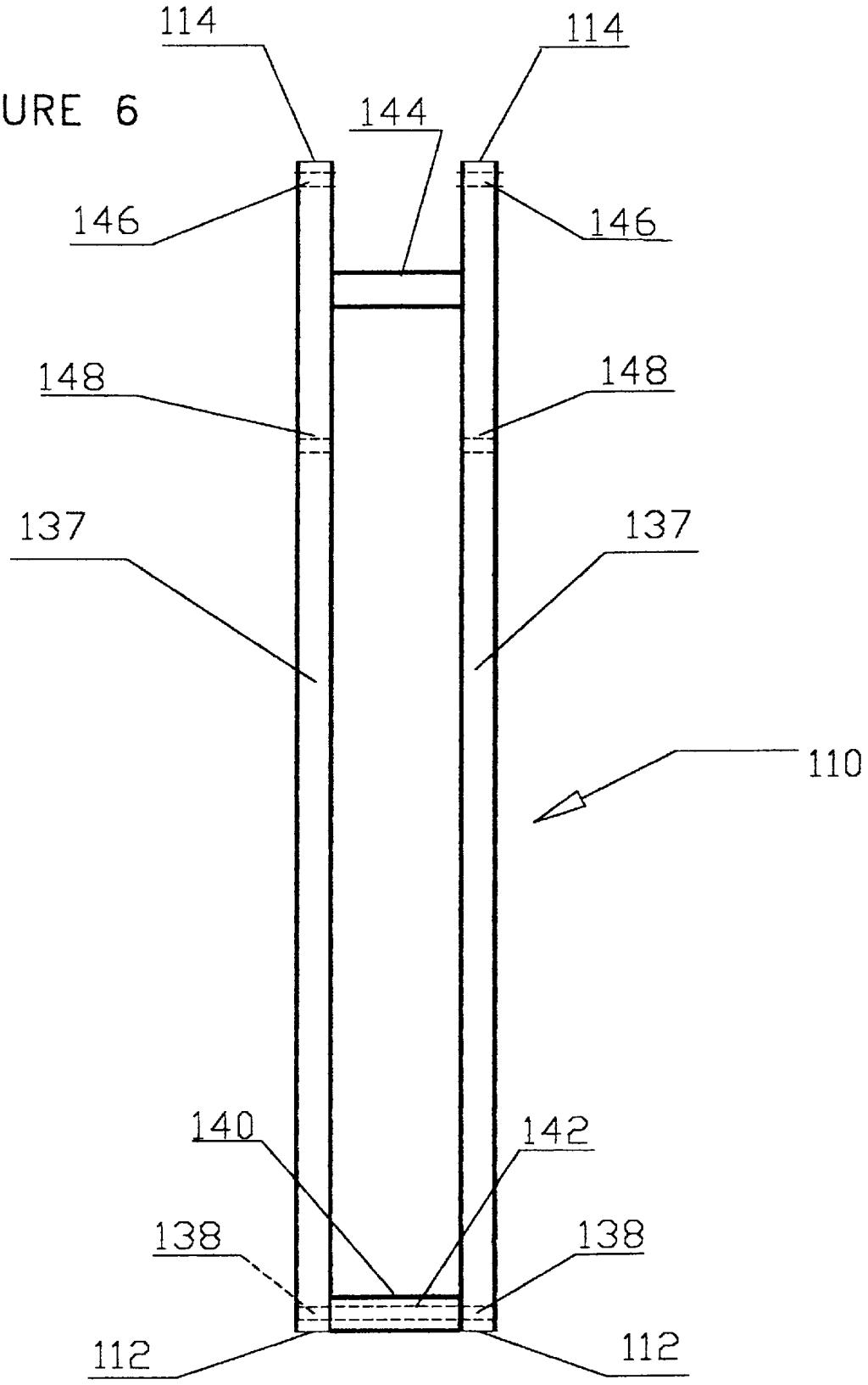
FIG. 6 is a top view of the first linkage member.

Referring to FIGS. 1 and 6 the first linkage member 110 comprises a pair of spaced apart elongate tube members 137 extending from the first end 112 to the second end 114. A hole 138 extends laterally through each elongate member 137 adjacent the first end 112 thereof. A spacer member 140 extends between and is fixed to the elongate members 137 between the holes 138 and includes a hole 142 extending laterally therethrough for alignment with the holes 138. The holes 138 and 142 are arranged to receive the pin 62 on the linkage mount 20 thereby pivotally connecting the first linkage member 110 to the linkage mount 20.

A connection member 144 extends between and is fixed to the elongate members 137 at a location spaced from the second ends 114 thereof. The connection member 137 provides strength and rigidity to the first linkage member 110.

A second hole 146 extends laterally through each of the elongate members 137 at the second end 114. The holes 146 are arranged to align with one another such that they can cooperate to receive a pin member therethrough. The holes 146 are arranged to align with the holes 68 and 74 of the tool carrier 22 to receive a pin member therethrough thereby pivotally connecting the tool carrier 22 and the first linkage member 110.

A third hole 148 extends laterally through each elongate member 137 at a location spaced downwards from the connection member 144. The holes 148 are arranged to align with one another to receive a pin member for pivotally connecting the third linkage member 122 to the first linkage member 110.

Figure 7:
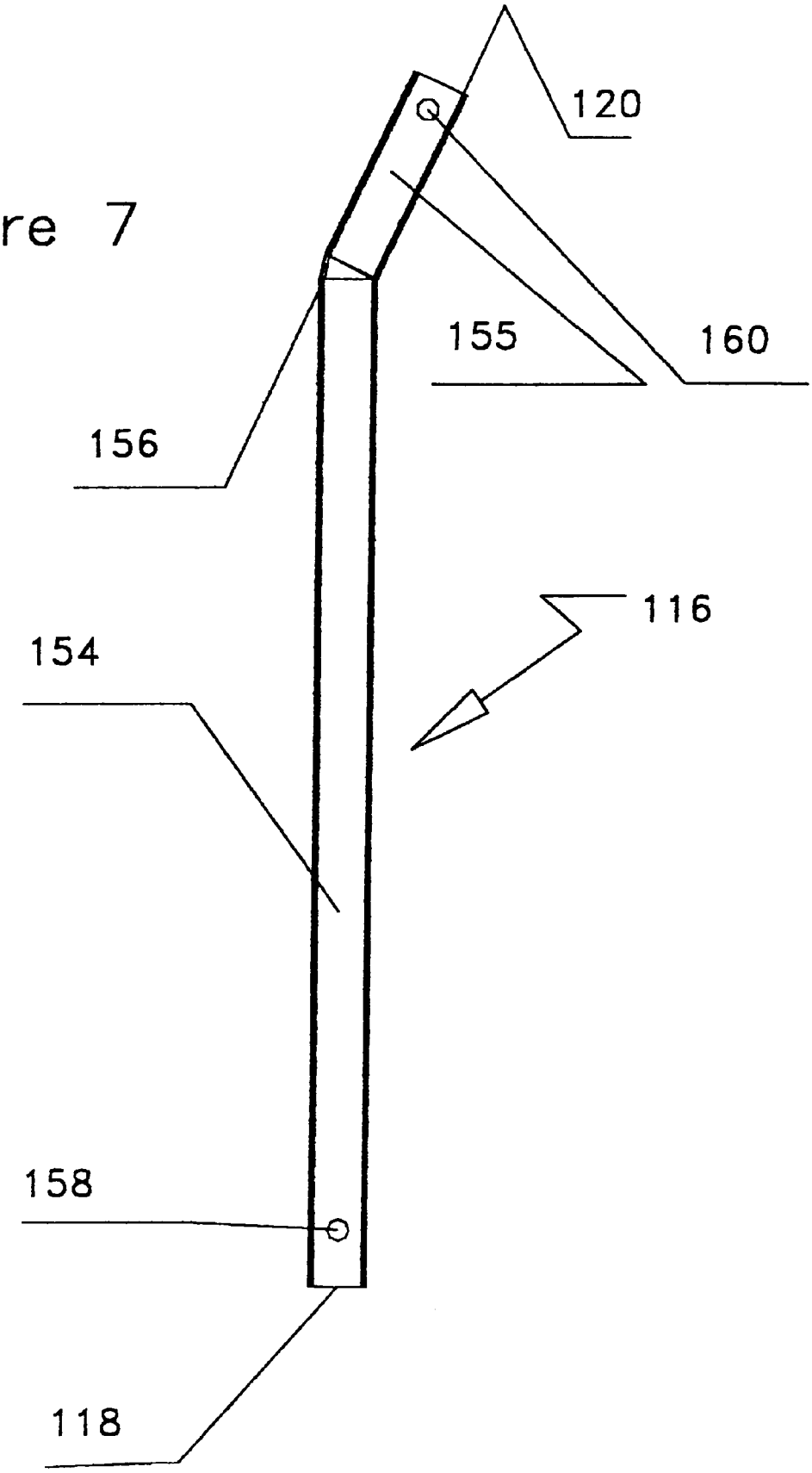
FIG. 7 is a side view of the second linkage member.

Referring to FIGS. 1 and 7 the second linkage member 116 is an elongate tubular member 154 and extends from its first end 118 to a second end 120. The elongate member 154 includes a downwardly and forwardly angled portion 155. The angled portion 155 angles starting at a point 156 which is spaced from the second end 120. A hole 158 extends laterally through the elongate member 154 adjacent the first end 118 thereof. The hole 158 is arranged to align with the holes 50 in the linkage mount 20. A pin 52 extends through the holes 50 and 158 thereby pivotally connecting the bottom end 118 of the second linkage member 116 to the linkage mount 20. A second hole 160 extends laterally through the angled portion 155 of the elongate member 154 near the second end 120.

Figure 8:
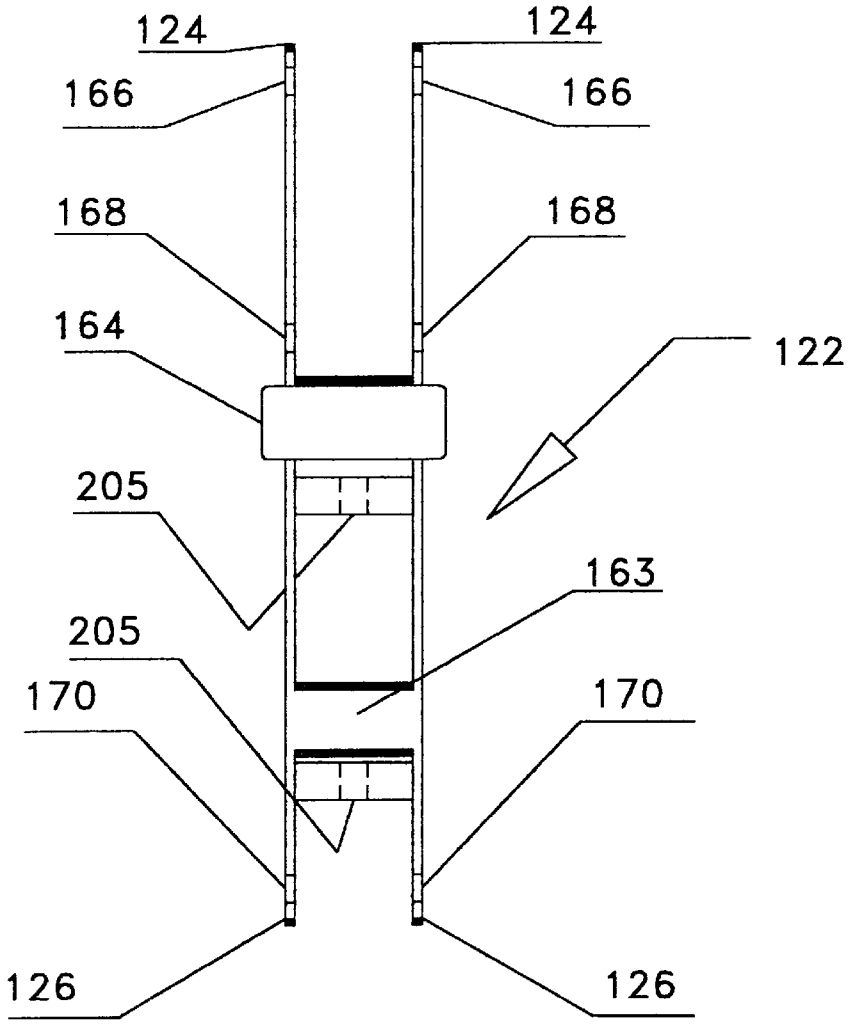
FIG. 8 is a top view of the third linkage member.

Referring to FIGS. 1 and 8 the third linkage member 122 comprises a pair of spaced apart elongate members 162 which extending from the first end 124 to the second end 126. The elongate members 162 are fixed relative to one another by a pair of connection members 163 and 164 which extend between the elongate members 162 at a point between the ends 124 and 126 thereof.

A hole 166 extends laterally through each elongate member 162 adjacent the first end 124 thereof. The holes 166 is arranged to cooperate with the hole 160 at the second end 120 of the second linkage member 116. A pin member extends through the holes 160 and 166 thereby pivotally connecting the top end 120 of the second linkage member 116 to the first end 124 of the third linkage member 122.

A second hole 168 extends laterally through each elongate member 162 at a point spaced from the hole 166 in a direction towards the second end 126. The holes 168 lie between the connection member 164 and the hole 166, and are arranged to cooperate with the holes 148 in the first linkage member 110 to receive a pin member therethrough thereby pivotally connecting the first linkage member 110 to the third linkage member 122.

A third hole 170 is arranged laterally through each elongate member 162 adjacent the second end 126 thereof. The holes 170 are arranged to cooperate with holes at the second end of the fourth linkage member 130.

Figure 9:
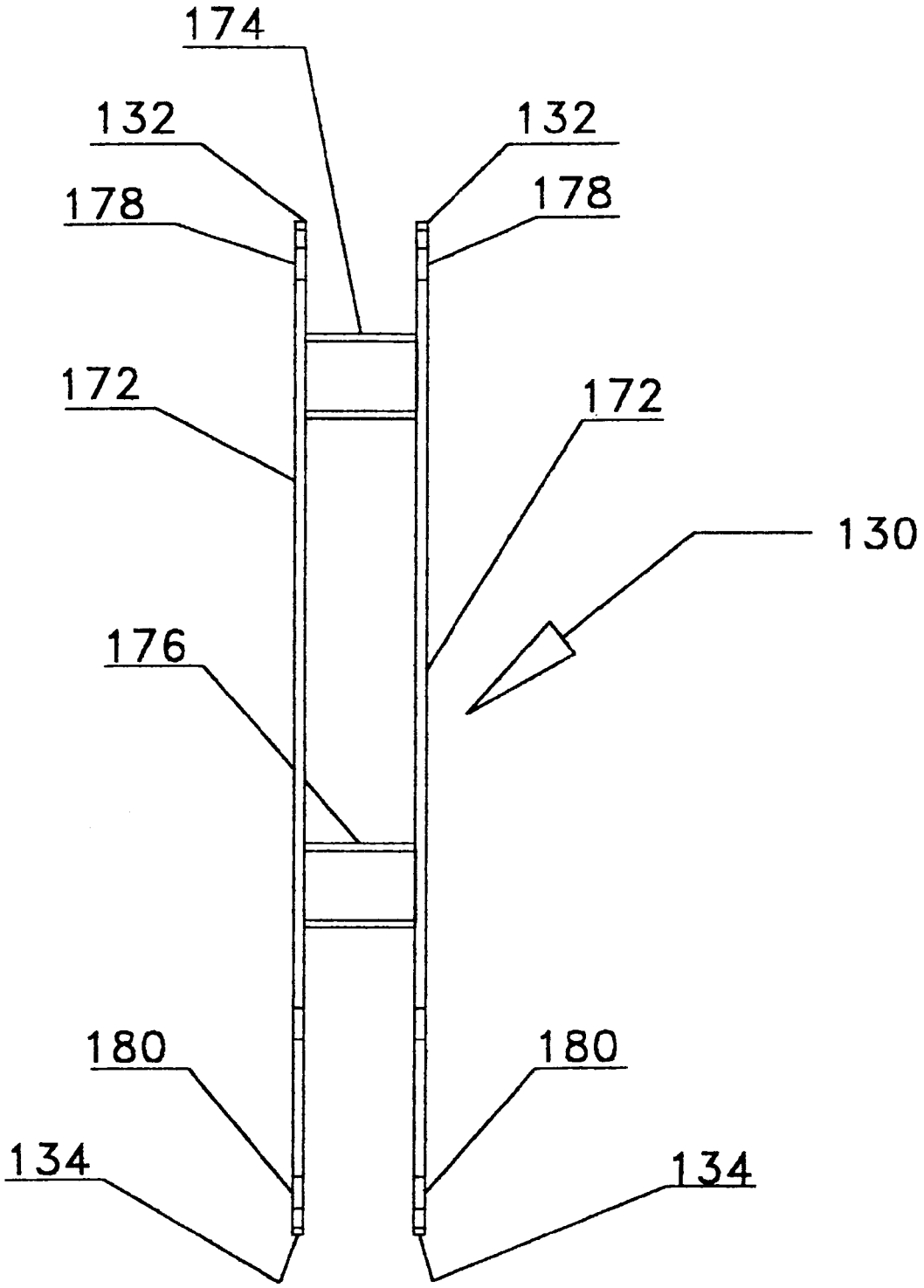
FIG. 9 is a top view of the fourth linkage member.
Figure 10:
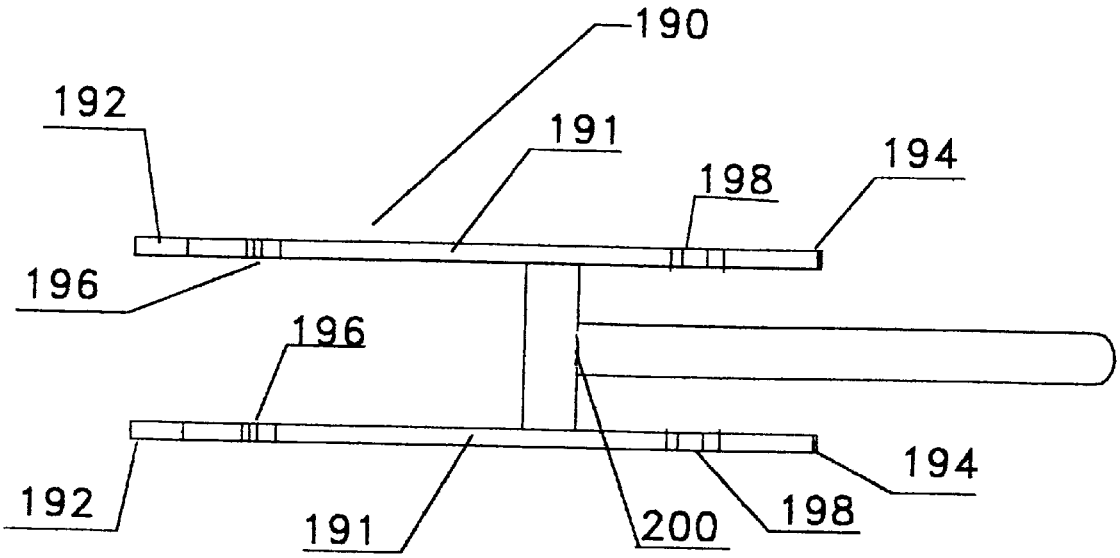
FIG. 10 is a top view of the latch member.
Figure 11:
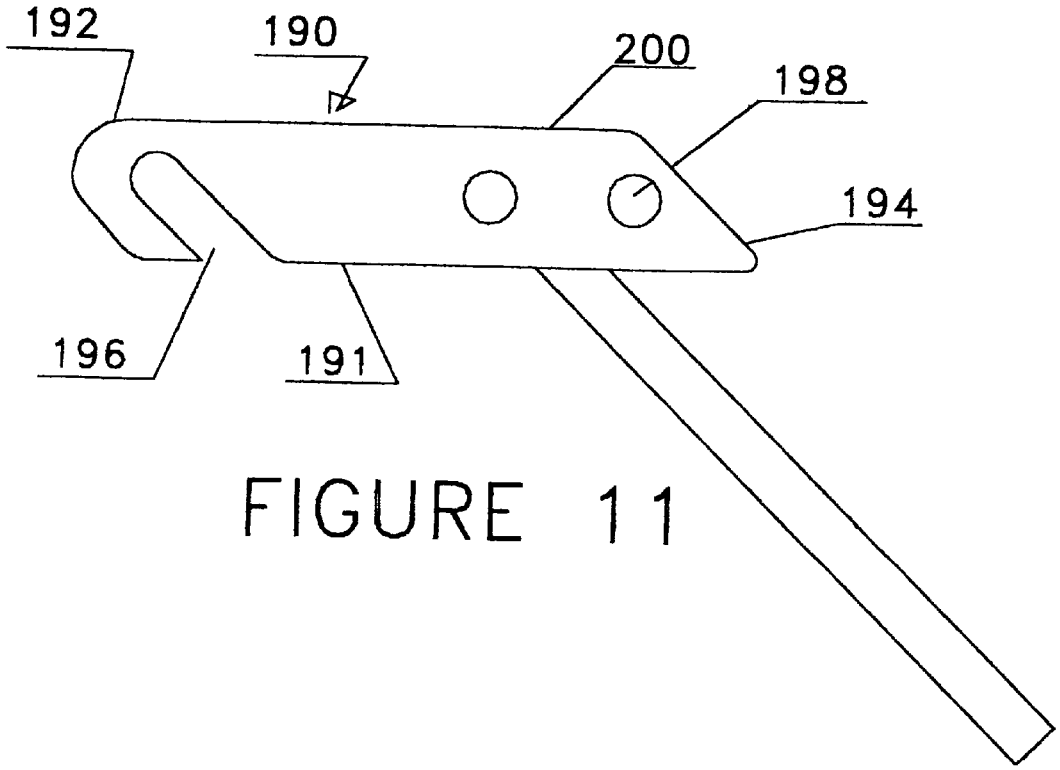
FIG. 11 is a side view of the latch member.

Referring to FIGS. 1 and 9 the fourth linkage member 130 comprises a pair of spaced apart elongate members 172 extending from a first end 132 to a second end 134. A pair of connection members 174 and 176 extend between and are fixed to the elongate members 172 to provide strength and rigidity to the linkage member 130. The connection members 174 and 176 are spaced inwards from respective ends 132 and 134.

A hole 178 is arranged adjacent the first end 132 of each elongate member 172 and extends laterally therethrough. The holes 178 are arranged to align with the corresponding holes 170 in the third linkage member 122. The holes 178 and 170 are arranged to receive a pin member therethrough thereby pivotally connecting a third and fourth linkage members 122 and 130.

A second hole 180 extends laterally through each of the elongate members 172 adjacent the second end 134 thereof. The holes 180 are arranged to align with a hole 182 in the flange 184 which is fixed to the leg 24. The flange 184 is located on the leg at a location spaced down from its top end 82. The holes 180 and 182 are arranged to receive a pin member therethrough thereby pivotally connecting the fourth linkage member 130 to the leg 24.

The linkage members 110, 116, 122 and 130 are sized and arranged such that as the linkage is moved from the stored position 16 adjacent the wall 12 to the use position 18 downwards and forwards of the stored position 16 the tool carrier 22 remains in a substantially horizontal position at all times throughout the movement.

The first, third, and fourth linkage members 110, 122, and 130 all comprise spaced apart elongate members to add strength and rigidity to the linkage 26 and to help resist twisting of the linkage 26 during movement between the stored position 16 and the use position 18.

Referring to FIGS. 2, 3, 5, 10 and 11 the retractable tool support 10 includes a latch 28 which comprises the latch pin 34 mounted on the wall bracket 32 at a position spaced upwards from the linkage mount 20. The latch pin 34 is arranged in a substantially horizontal plane and extends between the angle members 36 of the wall bracket 32. A latch member 190 comprises a pair of spaced apart elongate members 191 extending from a first end 192 to a second end 194 and has a notch 196 adjacent the first end 192. A hole 198 extends laterally through each elongate members 191 adjacent the second end 194 thereof and is arranged to align with the holes 160 in the second linkage member 116 and the holes 166 in the third linkage member and receive the pin extending therethrough. The latch member is mounted such that when the linkage is in the stored position the notch 196 at the first end 192 is positioned to engage the latch pin 34 on the wall 12.

The latch 190 includes a cross pin 200 (FIGS. 10 and 11) which extends between the elongate members 191 at a position between the notch 196 and the holes 198. The cross pin 200 is connected to the second linkage member 116 by a spring 197 (FIG. 2) which biases the notch 196 into contact with the latch pin 34.

Figure 12:
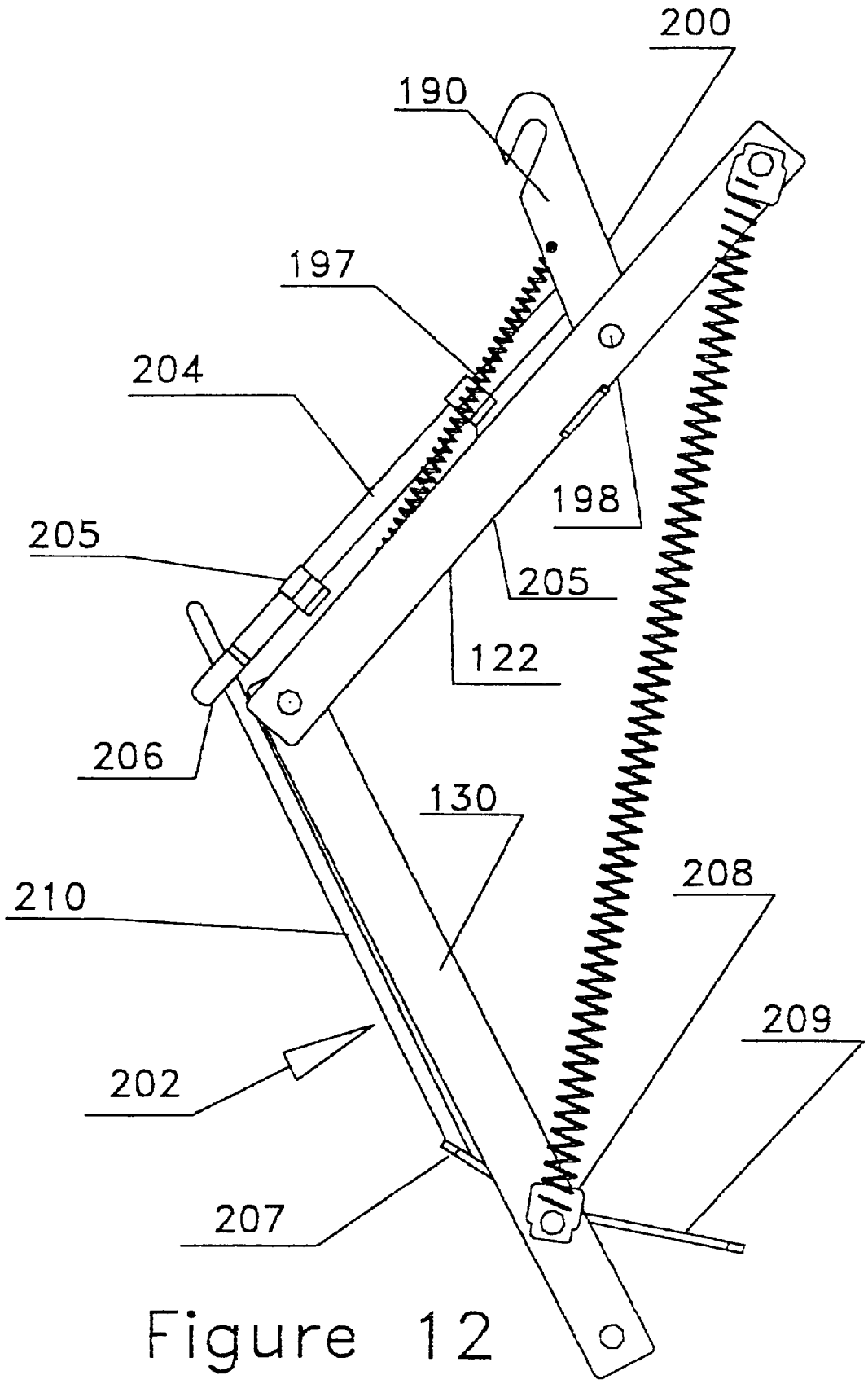
FIG. 12 is a side view of the latch release lever.

A release mechanism 202 shown in FIG. 12 is mounted on the linkage to release the latch 190. The release mechanism includes a rod 204 engaging the cross pin 200 and mounted on linkage member 122 by collars 205 to slide along the linkage member. The end of rod 204 remote from the latch 190 carries an inverted U-shaped stirrup 206. The release mechanism also includes a bell crank 207 mounted on linkage member 130 by a pivot connection 208. The bell crank includes a handle 209 extending upwards from the pivot connection 208 and an arm 210 extending rearwards pivot connection 208. The arm 210 engages the stirrup 206 when the handle 209 is pulled forwards, lifting the rod 204 and the latch 190 to disengage the notch 196 from the latch pin 34. This allows the tool support 10 to be moved from the stored position 16 into the use position 18.

The linkage 26 includes resilient means 30, which are a pair of coil springs extending from the third linkage member 122 to the fourth linkage member 130. The coil springs bias the linkage 26 towards the stored position 16 to counter balance the weight of the tool support 10 and tool making it easier for an individual to move the tool support between the stored position 16 to the use position 18.

In use, the retractable tool support 10 is mounted on the wall 12 or other supporting structure. The mounting bracket 32 is held in place by fasteners which engage the wall through the holes 60 and the mounting bracket 32. The upright support leg 24 is adjusted vertically until the foot 90 is in contact with the floor 14 when the tool support is in the use position 18. A tool is then mounted directly, or through a mounting plate or other mechanism, on the mount 22.

Once a tool is mounted on the tool carrier 22 and the tool support is in the use position 18 the tool can either be used or the tool and tool support 10 can be moved to the stored position 16. The tool and tool support 10 can be moved to the stored position 16 by moving the tool support 10 upwards and rearwards until the linkage members 110 and 116 are in the upright position and adjacent the wall 12. During this movement the tool carrier 22 remains in the horizontal position and the upright support 24 remains in the vertical position. When the retractable tool support 10 is fully in the stored position 16 the latch member 28 will engage the latch pin 34 such that the notch 196 engages the pin. The spring 197 biases the notch in place on the pin 34. In this position the tool sits on the tool carrier 22 in a horizontal position adjacent the wall and the upright support is suspended above the floor 14 with the foot 90 above the floor 14.

To move the tool from the stored position 16 back into the use position 18 the handle 208 of the release handle 209 is pulled, causing the arm 210 to move upwards, pushing the rod 204 to lift the latch 190. The latch 190 moves upwards against the biasing force of the spring 197 and the notch 196 disengages the pin 34, releasing the tool support to move downwards and forwards into the use position 18. During movement from the stored position 16 to the use position 18 the tool and tool carrier 22 remains in the horizontal plane.

The spring 212 which extends between the third and fourth linkage members 122 and 130 tends to bias linkage members 122 and 130 towards the stored position 16. This provides a counter force which slows the downward movement of the tool and tool support 10 enabling an individual to lower the tool easily into the use position. Likewise the spring 212 makes it easier to move the tool from the use position 18 to the stored position 16 since the spring 212 works with the individual as the individual moves the retractable tool support 10 upwards.

In one alternative arrangement the tool carrier 22 may be mounted to lie in a vertical plane for use with tools which may be more easily mounted in this manner.

In a second alternative embodiment a turntable 214 may be mounted on top of the tool carrier 22 the turntable 214 enables a tool mounted on the tool carrier 22 to be rotated through a range of positions in the plane of the tool carrier 22.

The tool support may be mounted on any appropriate vertical surface, for example a column, or the side of a work bench, which are for the purposes of this application considered to be walls.

The term tool for the purposes of this application is meant generally and is considered to include any device or item which it may be desirable to support on a retractable support of the type described. One example of which is a work bench.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A retractable tool support for mounting a tool on a mounting structure above a floor for movement between a stored position and a use position, said tool support comprising:

mounting means for mounting the tool support on the mounting structure;

a tool carrier for carrying the tool;

a linkage coupling the mounting means and the tool carrier, the linkage constraining the tool carrier to move relative to the mounting structure between a stored position adjacent the mounting structure and a use position spaced from the mounting structure and below the stored position, the linkage constraining the tool carrier to remain in a horizontal orientation in the stored and use positions and during movement between the stored and use positions;

a carrier support strut depending from the tool carrier and supporting the tool carrier on the floor in the use position; and selectively releasable latch means for latching the tool support in the stored position.

2. A tool support according to claim 1 wherein the mounting means comprise a unitary mounting base.

3. A tool support according to claim 1 wherein the carrier support strut is a leg mounted on the tool carrier.

4. A tool support according to claim 3 wherein the leg includes adjustment means for vertically adjusting the length of the leg.

5. A retractable tool support for mounting a tool for movement between a stored position adjacent an upright mounting structure and a use position below the stored position and spaced from the upright mounting structure, said tool support comprising:

mounting means for mounting the tool support on the mounting structure:

a linkage having a first end connected to the mounting means and a second end:

a leg;

a tool carrier for carrying the tool In an upright orientation, the tool carrier being pivotally connected to the second end of the linkage, the linkage constraining the tool carrier to move between the stored and use positions with the tool remaining in said upright orientation, and the tool carrier being fixed adjacent a forward end to a top end of the leg for supporting the tool carrier and the tool in the use position; and selectively releasable latch means for latching the tool support in the stored position.

6. A tool support according to claim 1 wherein the linkage comprises two four bar linkages connected in series between the mounting means and the tool carrier, the two four bar linkages having two pivotally connected common bars.

7. A retractable tool support, for mounting a tool for movement between a stored position adjacent in upright mounting structure and a use position below the stored position and spaced from the upright mounting structure, said tool support comprising:

mounting means for mounting the tool support on the mounting structure;

a tool carrier for carrying the tool in an upright orientation;

a linkage coupling the mounting means an the tool carrier for constraining the tool carrier to move between the stored and use positions with the tool remaining in said upright orientation, the linkage comprising two four bar linkages connected in series between the mounting means and the tool carrier, the two four bar linkages having two pivotally connected common bars, wherein one of the common bars is a first bar pivotally connected to the mounting means, the linkage includes a second bar pivotally connected to the mounting means, a third bar pivotally connected to the tool carrier, and the other of the common bars is a fourth bar pivotally connected to the first, second and third bars, with the connection to the first bar being between the connections to the second and third bars;

a carrier support strut supporting the tool carrier means and the tool in the use position; and selectively releasable latch means for latching the tool carrier in the stored position.

8. A tool support according to claim 7 wherein the carrier support strut is a leg rigidly mounted on the tool carrier and the third bar of the linkage means is pivotally connected to the leg.

9. A tool support according to claim 1 wherein the latch means comprises:

a latch pin;

means for mounting the latch pin on the mounting structure; and a latch member mounted pivotally on the linkage and having a notch for engaging the latch pin for securing the tool support in the stored position.

10. A tool support according to claim 9 wherein the latch means includes latch release linkage mounted on the linkage and including a handle adjacent the carrier support strut.

11. A tool support according to claim 1 wherein the linkage includes biasing means biasing the tool support towards the stored position.

* * * * *